US012758004B2

(12) United States Patent
Terry

(10) Patent No.: US 12,758,004 B2
(45) Date of Patent: Oct. 13, 2026

(54) TOOTHPASTE, MOUTHWASH AND DISINFECTING WIPE DISPENSING TOOTHBRUSH DEVICE

(71) Applicant: Alonzo Terry, Florissant, MO (US)

(72) Inventor: Alonzo Terry, Florissant, MO (US)

( * ) Notice: Subject to any disclaimer, the term of this patent is extended or adjusted under 35 U.S.C. 154(b) by 23 days.

(21) Appl. No.: 19/172,861

(22) Filed: Apr. 8, 2025

(65) Prior Publication Data

US 2025/0234987 A1 Jul. 24, 2025

Related U.S. Application Data

(63) Continuation-in-part of application No. 18/367,263, filed on Sep. 12, 2023, now abandoned.

(51) Int. Cl.
*A46B 11/00* (2006.01)
*A46B 15/00* (2006.01)

(52) U.S. Cl.
CPC ..... *A46B 11/0031* (2013.01); *A46B 15/0065* (2013.01); *A46B 15/0071* (2013.01); *A46B 15/0081* (2013.01); *A46B 2200/1066* (2013.01)

(58) Field of Classification Search
CPC ..... A46B 2200/1066; B65D 47/263
See application file for complete search history.

(56) References Cited

U.S. PATENT DOCUMENTS 307,661 A * 11/1884 Kells, Jr. ..... B65D 47/263 222/553
1,711,183 A * 4/1929 Smith ..... A46B 11/0027 401/175
3,738,762 A * 6/1973 Moore ..... A46B 11/0041 401/184
4,145,147 A * 3/1979 Schuck ..... A46B 11/0027 401/175
4,277,194 A 7/1981 Smith
4,844,641 A 7/1989 Grossfilley
5,160,077 A * 11/1992 Sticklin ..... A47F 1/04 225/41
5,769,553 A * 6/1998 Chaudhri ..... A46B 15/0067 401/125
5,888,578 A 3/1999 Sanduja
6,397,860 B1 * 6/2002 Hill, II ..... A45D 44/18 132/309
7,311,456 B1 12/2007 Neal
2006/0260635 A1 * 11/2006 Dabney ..... A46B 15/0055 132/309

(Continued)

FOREIGN PATENT DOCUMENTS

CA 2254031 5/2000

*Primary Examiner* — David P Angwin
*Assistant Examiner* — Bradley S Oliver

(57) ABSTRACT

A toothpaste, mouthwash, and disinfecting wipe dispensing toothbrush device for performing dental and oral hygiene includes a toothbrush that has a toothpaste reservoir which contains a fluid toothpaste. The toothpaste reservoir is in communication with a plurality of bristles of the toothbrush to release the fluid toothpaste onto a user's teeth for brushing the user's teeth. The toothbrush has a mouthwash reservoir which contains a liquid mouthwash. The toothbrush has a toothpaste dispenser for urging the fluid toothpaste onto the plurality of bristles. The toothbrush has a mouthwash dispenser to release the fluid mouthwash into the user's mouth.

14 Claims, 7 Drawing Sheets

(56) References Cited

U.S. PATENT DOCUMENTS

| | | | | |
|---|---|---|---|---|
| 2011/0286783 | A1* | 11/2011 | Harden | A46B 15/0061 401/175 |
| 2017/0071329 | A1* | 3/2017 | Duncan | A46B 11/0003 |

* cited by examiner

TOOTHPASTE, MOUTHWASH AND DISINFECTING WIPE DISPENSING TOOTHBRUSH DEVICE

CROSS-REFERENCE TO RELATED APPLICATIONS

This application is a continuation in part of application Ser. No. 18/367,263 filed Sep. 12, 2023.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dispensing toothbrush devices and more particularly pertains to a new dispensing toothbrush device for dispensing toothpaste, mouthwash and sanitary wipes. The device includes a toothbrush which as a toothpaste reservoir containing a fluid toothpaste and a mouthwash reservoir containing a liquid mouthwash. The device includes a toothpaste dispenser for dispensing the fluid toothpaste and a mouthwash dispenser for dispensing the mouthwash. The toothbrush further has a compartment holding disinfecting wipes.

(2) Description of Related Art Including Information Disclosed Under 37 CFR 1.97 and 1.98

The prior art relates to dispensing toothbrush devices including a variety of toothbrush devices that each includes a toothpaste reservoir and a toothpaste dispenser and a toothbrush device that includes a plurality of reservoirs each containing respective oral hygiene agents and a plurality of plungers for dispensing respective oral hygiene agents. In no instance does the prior art disclose a toothbrush device that has a toothpaste reservoir and a mouthwash reservoir and a spool of dental floss and a toothpaste dispenser and a mouthwash dispenser.

BRIEF SUMMARY OF THE INVENTION

An embodiment of the disclosure meets the needs presented above by generally comprising a toothbrush that has a toothpaste reservoir which contains a fluid toothpaste. The toothpaste reservoir is in communication with a plurality of bristles of the toothbrush to release the fluid toothpaste onto a user's teeth for brushing the user's teeth. The toothbrush has a mouthwash reservoir which contains a liquid mouthwash.

The toothbrush has a toothpaste dispenser for urging the fluid toothpaste onto the plurality of bristles. The toothbrush has a mouthwash dispenser to release the fluid mouthwash into the user's mouth.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
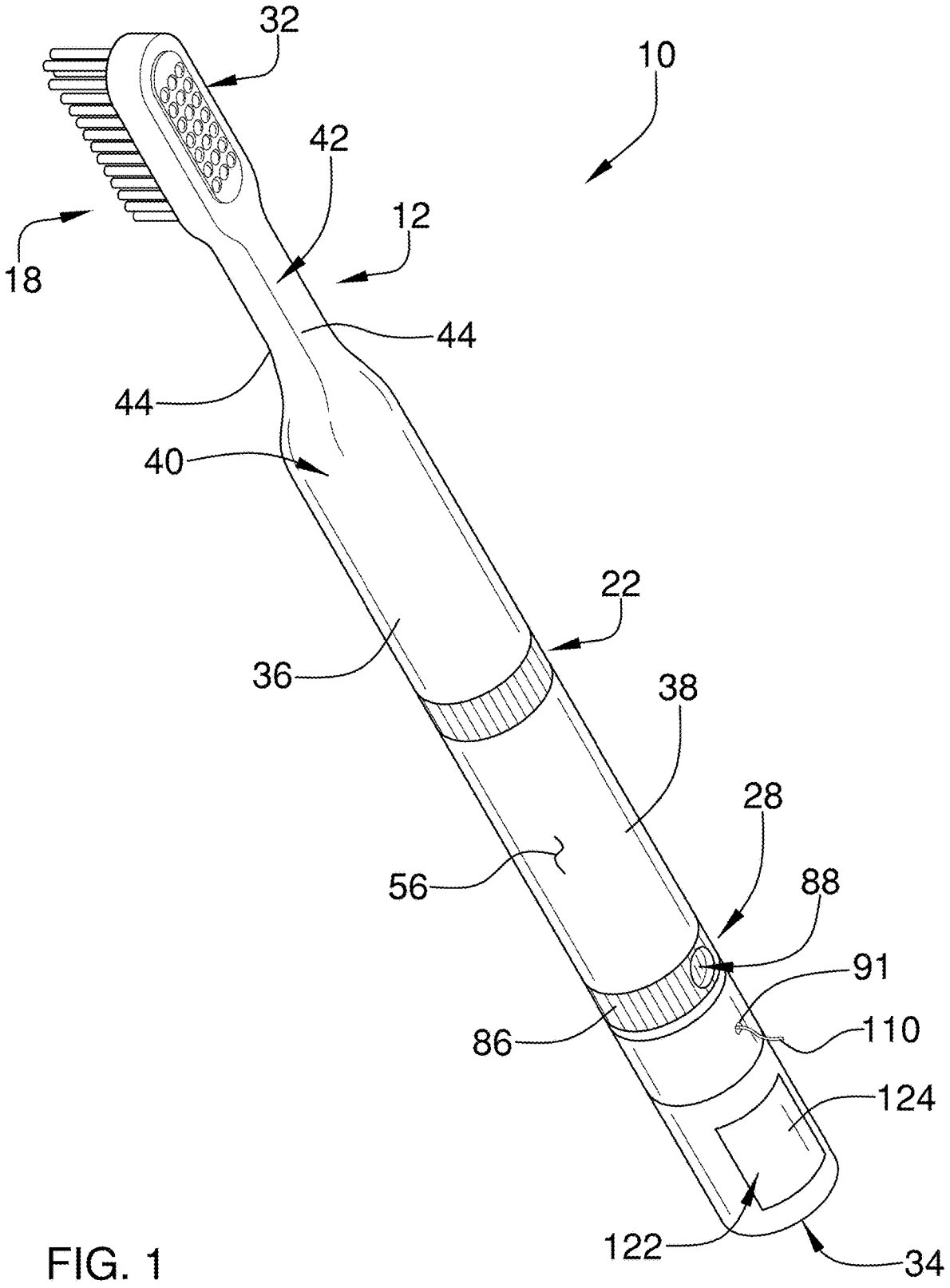
FIG. 1 is a perspective view of a toothpaste, mouthwash, and disinfecting wipe dispensing toothbrush device according to an embodiment of the disclosure.
Figure 2:
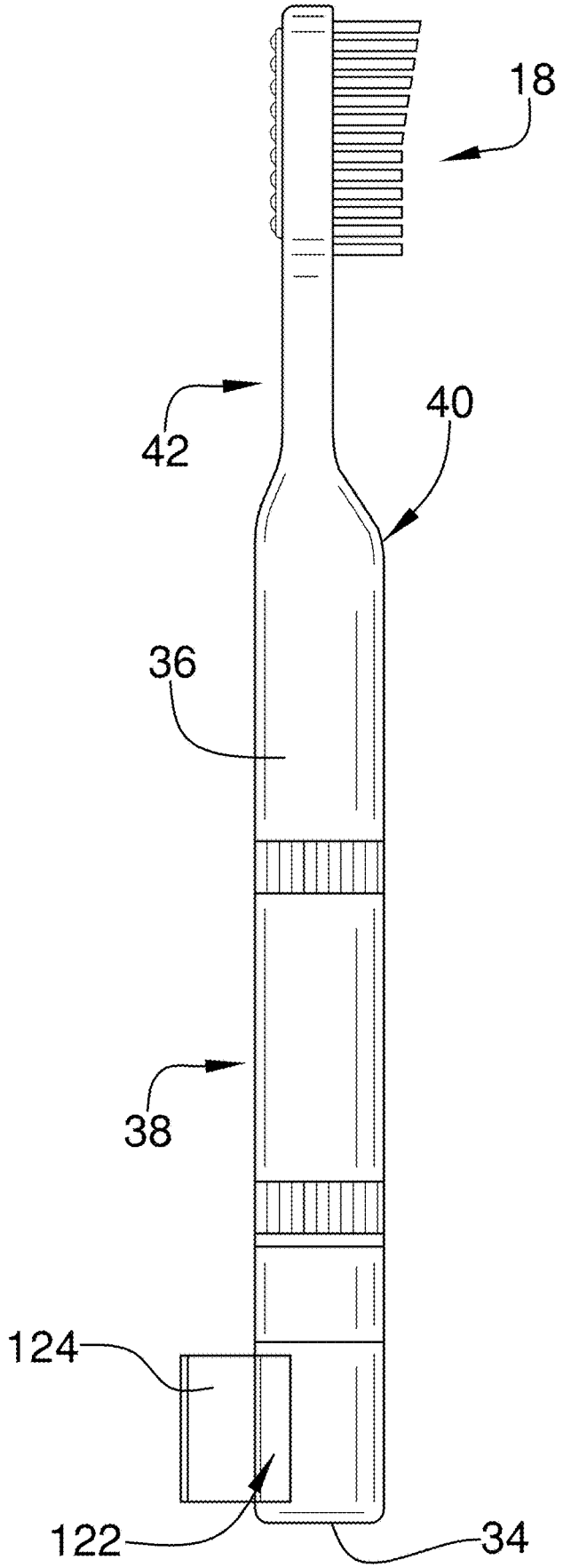
FIG. 2 is a right side view of an embodiment of the disclosure.
Figure 3:
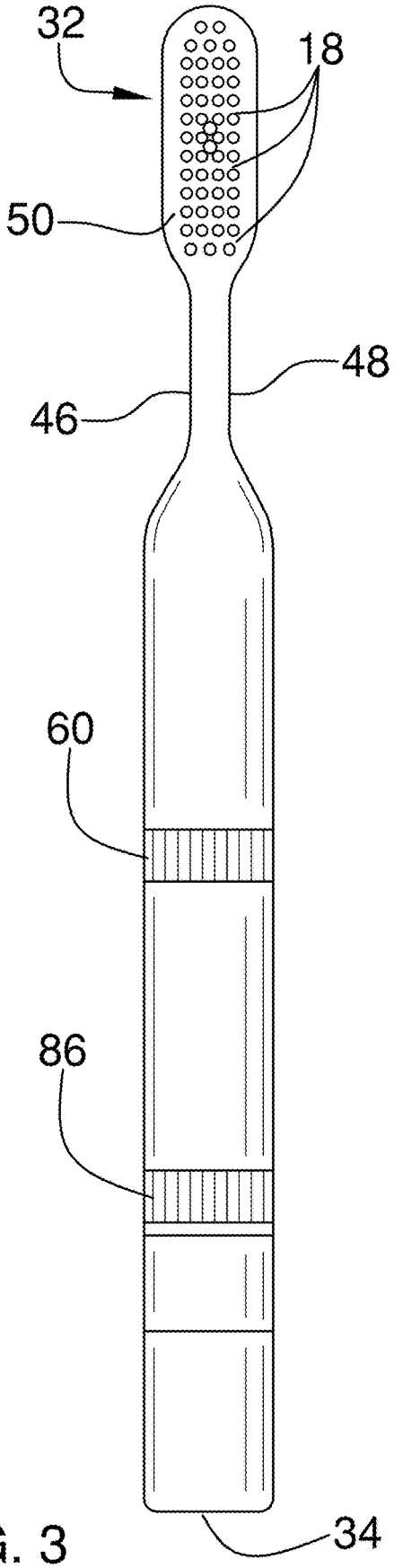
FIG. 3 is a bottom view of an embodiment of the disclosure.
Figure 4:
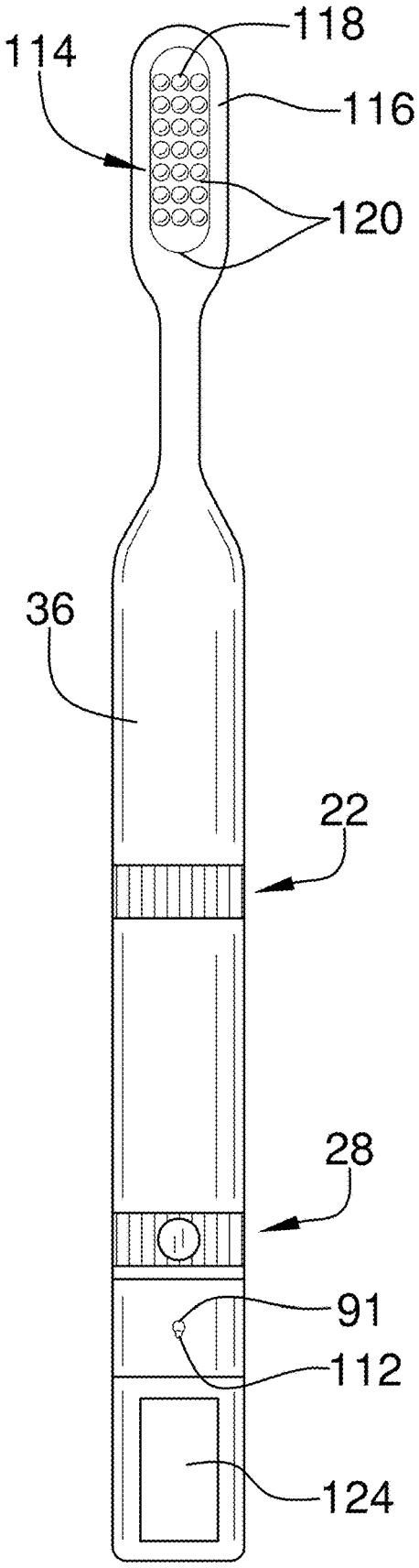
FIG. 4 is a top view of an embodiment of the disclosure.
Figure 5:
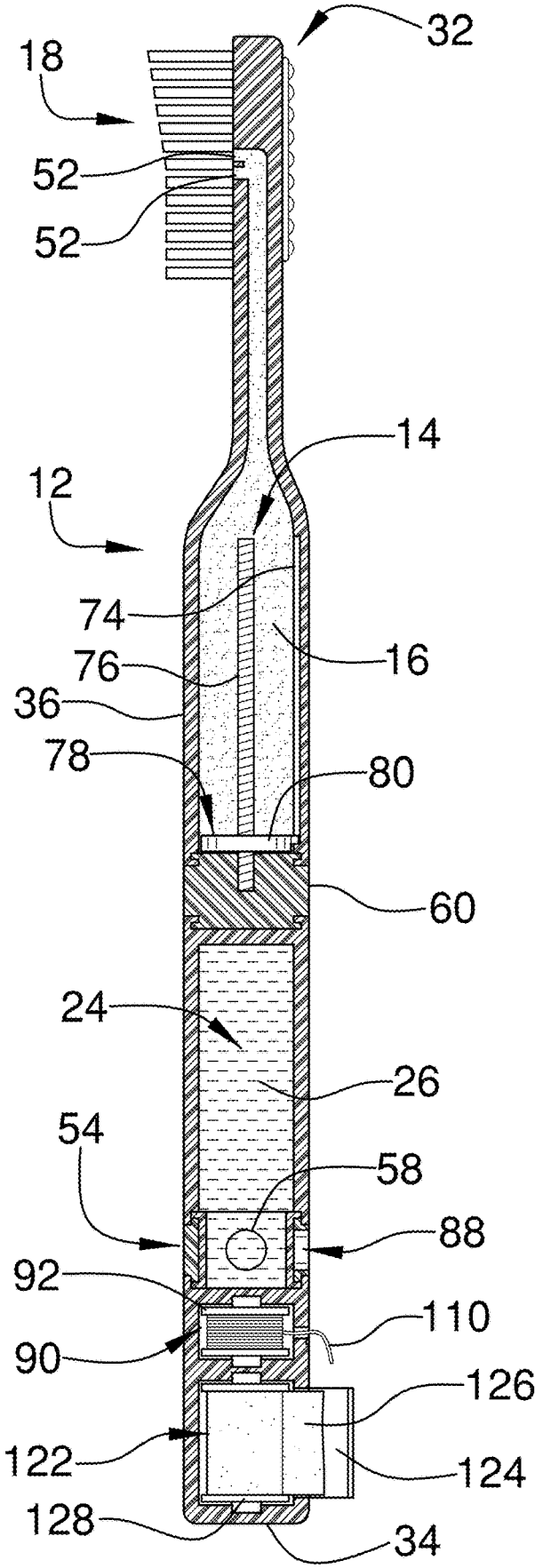
FIG. 5 is a cross sectional view taken along line 5-5 of FIG. 3 of an embodiment of the disclosure.
Figure 6:
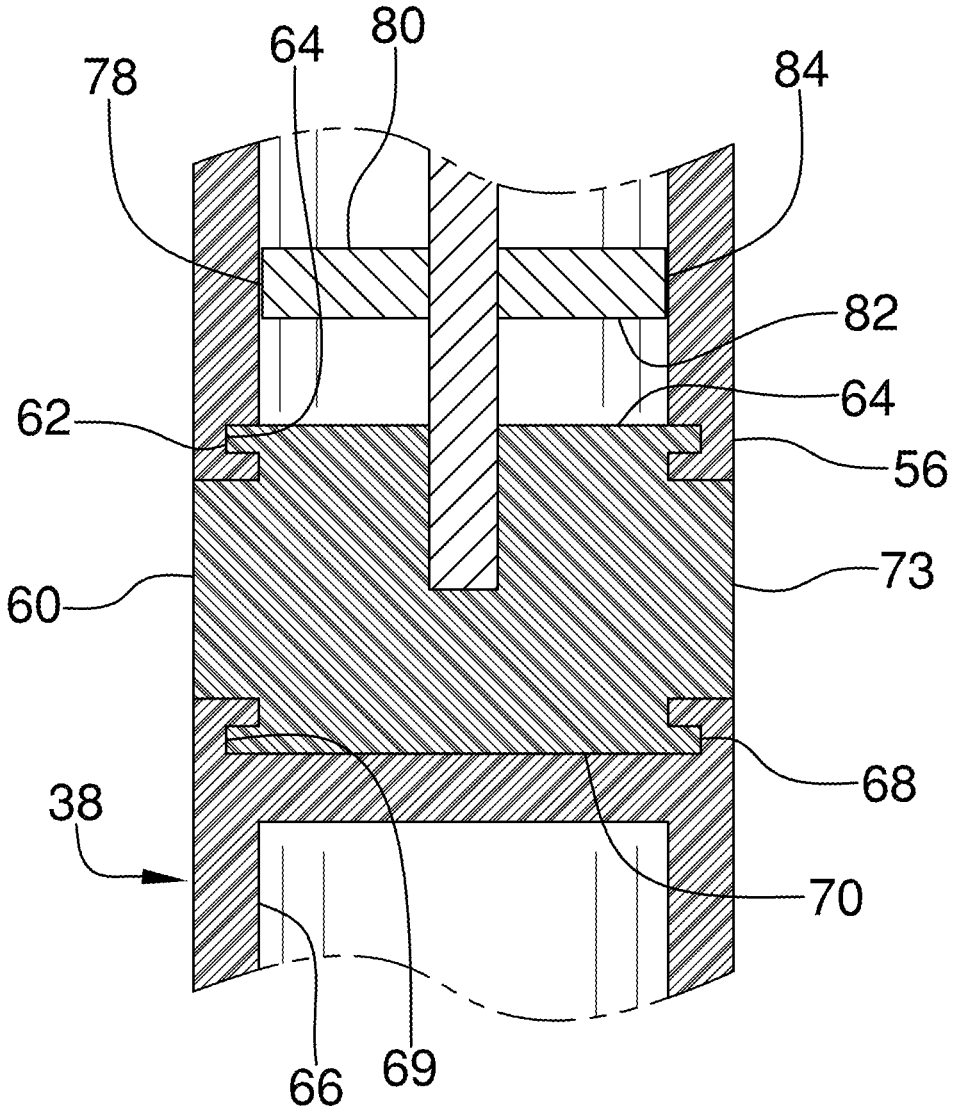
FIG. 6 is a magnified detail view of an embodiment of the disclosure.
Figure 7:
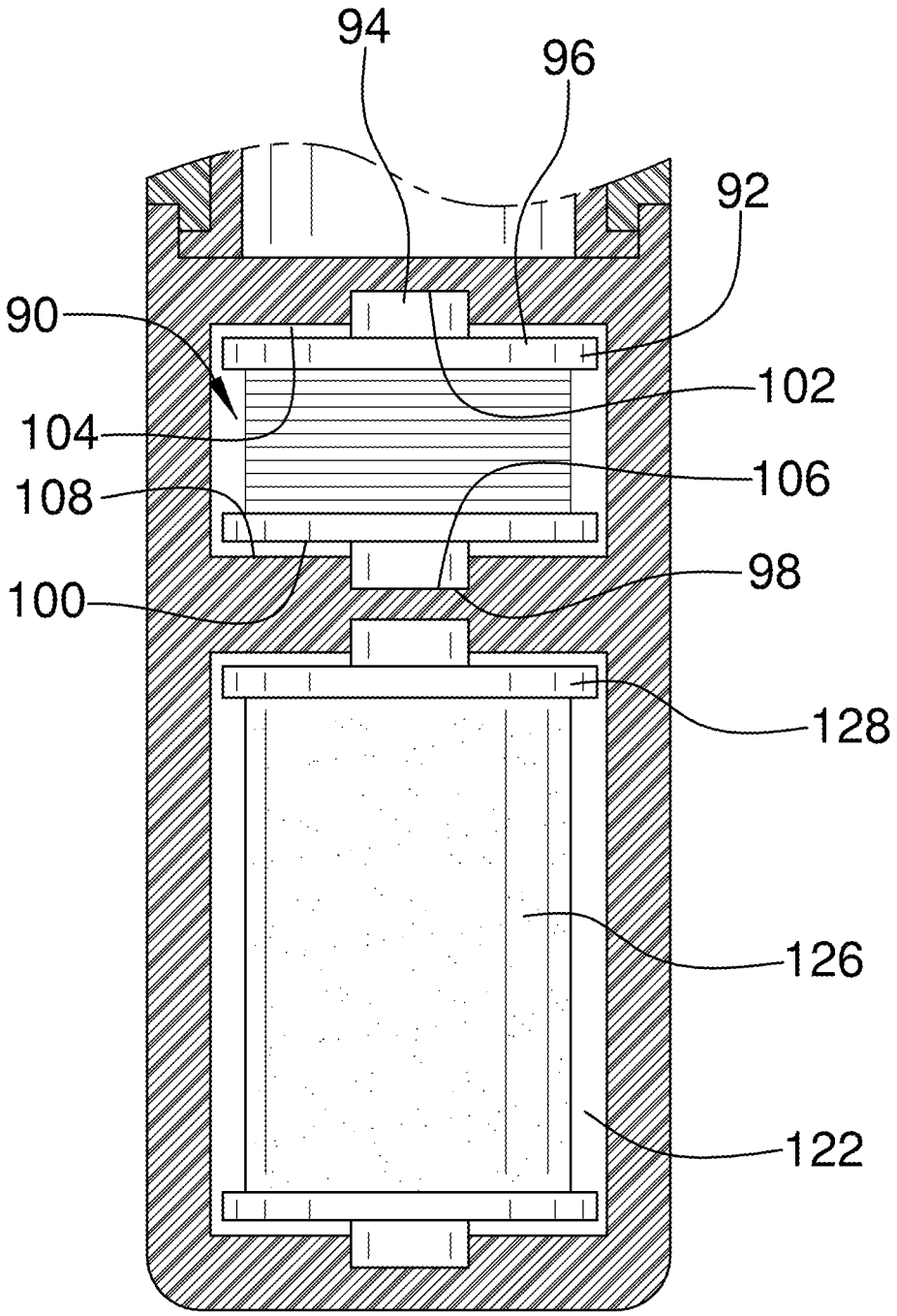
FIG. 7 is a magnified detail view of an embodiment of the disclosure.
Figure 8:
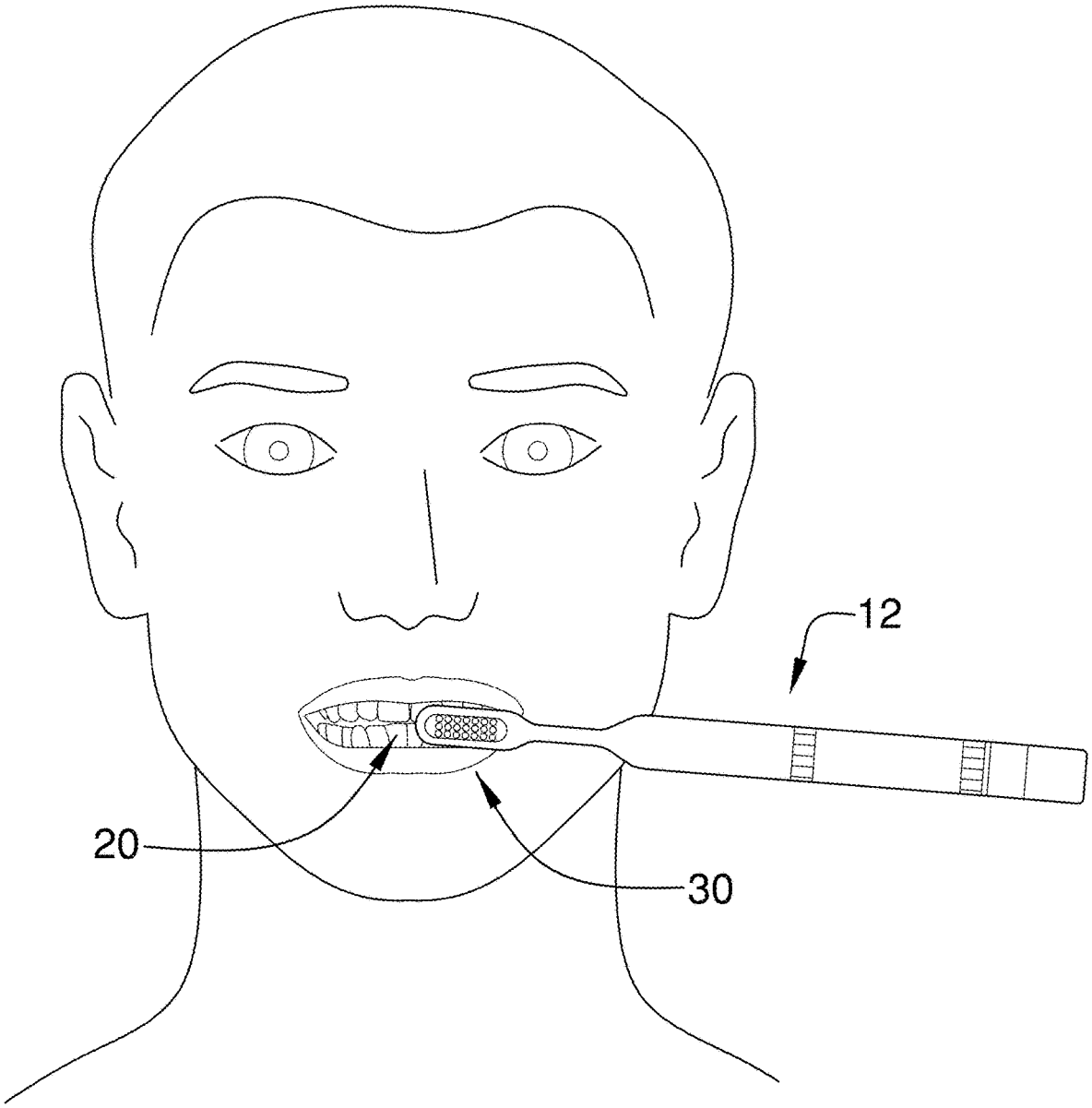
FIG. 8 is a perspective in-use view of an embodiment of the disclosure.

With reference now to the drawings, and in particular to FIGS. 1 through 8 thereof, a new dispensing toothbrush device embodying the principles and concepts of an embodiment of the disclosure and generally designated by the reference numeral 10 will be described.

As best illustrated in FIGS. 1 through 8, the toothpaste, mouthwash, and disinfecting wipe dispensing toothbrush device 10 generally comprises a toothbrush 12 that has a toothpaste reservoir 14 containing a fluid toothpaste 16. The toothpaste reservoir 14 is in communication with a plurality of bristles 18 of the toothbrush 12 to release the fluid toothpaste 16 onto a user's teeth 20 for brushing the user's teeth 20. The toothbrush 12 has a toothpaste dispenser 22 that is in communication with the toothpaste reservoir 14 and the toothpaste dispenser 22 is actuatable into a dispensing condition for urging the fluid toothpaste 16 onto the plurality of bristles 18. The toothbrush 12 has a mouthwash reservoir 24 which contains a liquid mouthwash 26 and the toothbrush 12 has a mouthwash dispenser 28 that is in communication with the mouthwash reservoir 24. The mouthwash dispenser 28 is positionable in an open condition to release the liquid mouthwash 26 into the user's mouth 30. Conversely, the mouthwash dispenser 28 is positionable in a closed condition to inhibit the liquid mouthwash 26 from flowing out of the mouthwash reservoir 24. The fluid toothpaste 16 may be any toothpaste that is approved for use by the American Dental Associated for dental care and the liquid mouthwash 26 may be any type of mouthwash that is approved for oral and dental hygiene.

The toothbrush 12 has a head 32, a base 34 and an outside wall 36 extending between the head 32 and the base 34 and the outside wall 36 has a bottom portion 38, a middle portion 40 and a top portion 42; the middle portion 40 slopes inwardly between the bottom portion 38 and the top portion 42. The outside wall 36 associated with each of the bottom portion 38 and the middle portion 40 is continuously arcuate about an axis extending between the base 34 and the head 32 such that each of the bottom portion 38 and the middle portion 40 has a cylindrical shape. The top portion 42 has a plurality of intersecting sides 44 that are perpendicularly oriented with each other such that the top portion 42 has a rectangular shape. Each of a first lateral side 46 and a second lateral side 48 associated with the plurality of intersecting sides 44 curves outwardly at a center point of the top portion 42 to define the head 32 of the toothbrush 12; each of the plurality of bristles 18 is positioned on a bottom side 50 of the head 32. As is most clearly shown in FIG. 2, the top portion 42 is offset from a middle of the bottom portion 38.

The toothpaste reservoir 14 is positioned in the bottom portion 38 of the outside wall 36 and extends into the top portion 42 of the outside wall 36. The head 32 has a pair of toothpaste openings 52 each extending through the bottom side 50 of the head 32 into the toothpaste reservoir 14 thereby facilitating the fluid toothpaste 16 to flow outwardly through the pair of toothpaste openings 52. The bottom portion 38 of the outside wall 36 has a recess 54 extending into an outside surface 56 of the bottom portion 38 of the outside wall 36. The recess 54 extends around a full circumference of the bottom portion 38 and the recess 54 is spaced from the base 34. The bottom portion 38 of the outside wall 36 has a first opening 58 extending into the mouthwash reservoir 24 thereby facilitating the first opening 58 to release the liquid mouthwash 26 from the mouthwash reservoir 24 and the first opening 58 is positioned in the recess 54.

The toothpaste dispenser 22 comprises a first disk 60 that is rotatably integrated into the bottom portion 38 of the outside wall 36. The first disk 60 has a first ledge 62 extending laterally away from a point located adjacent to an upper end 64 of the first disk 60 which slidably engages a first recess 64 in an interior surface 66 of the bottom portion 38 of the outside wall 36. The first disk 60 has a second ledge 68 extending laterally away from a point located adjacent to a lower end 70 of the first disk 60 which slidably engages a second recess 69 in the interior surface 66 of the bottom portion 38 of the outside wall 36. In this way the first disk 60 can be rotated about the axis extending between the base 34 and the head 32 of the toothbrush 12. Furthermore, the upper end 64 of the first disk 60 defines a lower threshold 72 of the toothpaste reservoir 14. An outermost surface 73 of the first disk 60 is spaced outwardly from each of the first ledge 62 and the second ledge 68 such that said outermost surface 73 is aligned with the outside surface 56 of the bottom portion 38 of the outside wall 36.

The toothpaste dispenser 22 includes a rail 74 that is integrated into the interior surface 66 of the bottom portion 38 of the outside wall 36 and the rail 74 is oriented to extend along a line that is parallel to the axis extending between the base 34 and the head 32 of the toothbrush 12. The screw 76 is attached to and extends upwardly from the upper end 64 of the first disk 60 such that the screw 76 extends into the toothpaste reservoir 14. The toothpaste dispenser 22 includes a second disk 78 positioned within the toothpaste reservoir 14 and the screw 76 extends through a top surface 80 and a bottom surface 82 of the second disk 78. A perimeter edge 84 of the second disk 78 engages the rail 74 thereby inhibiting the second disk 78 from rotating. The second disk 78 travels upwardly along the screw 76 when the first disk 60 is rotated in a first direction such that the second disk 78 urges the fluid toothpaste 16 to travel outwardly through the pair of toothpaste openings 52 for releasing the fluid toothpaste 16 onto the plurality of bristles 18. Conversely, the second disk 78 travels downwardly along the screw 76 when the first disk 60 is rotated in a second direction.

The mouthwash dispenser 28 comprises an annular ring 86 that is rotatably positioned in the recess 54 in the bottom portion 38 of the outside wall 36 of the toothbrush 12. The annular ring 86 has a second opening 88 extending through the annular ring 86. The annular ring 86 is rotatable into a dispensing position having the second opening 88 being aligned with the first opening 58 in the bottom portion 38 of the outside wall 36 thereby facilitating the second opening 88 to release the liquid mouthwash 26 from the mouthwash reservoir 24. Conversely, the annular ring 86 is rotatable into a closed position having the second opening 88 being offset from the first opening 58 thereby inhibiting the liquid mouthwash 26 from flowing from the mouthwash reservoir 24.

The toothbrush 12 has a floss chamber 90 that is integrated into an interior of the toothbrush 12. The floss chamber 90 is positioned between the base 34 of the toothbrush 12 and the mouthwash reservoir 24. The bottom portion 38 of the outside wall 36 of the toothbrush 12 has a floss opening 91 that extends into the floss chamber 90. A spool of dental floss 92 is rotatably positioned in the floss chamber 90. The spool of dental floss 92 has a first knob 94 extending away from a top side 96 of the spool of dental floss 92 and the spool of dental floss 92 has a second knob 98 extending away from a bottom side 100 of the spool of dental floss 92. The first knob 94 extends into an engagement recess 102 in an upper wall 104 of the floss chamber 90 and the second knob 98 extends into an engagement recess 106 in a lower wall 108 of the floss chamber 90 for rotatably retaining the spool of dental floss 92 in the floss chamber 90. The dental floss 110 extends outwardly through the floss opening 91 in the bottom portion 38 of the outside wall 36 of the toothbrush 12 thereby facilitating the dental floss 110 to be pulled from the spool of dental floss 92.

A floss cutter 112 is provided and the floss cutter 112 is attached to the bottom portion 38 of the outside wall 36 of the toothbrush 12. The floss cutter 112 is positioned adjacent to the floss opening 91 in the bottom portion 38 of the outside wall 36 thereby facilitating the dental floss 110 that is pulled outwardly from the floss opening 91 to be cut. In this way the dental floss 110 that is pulled outwardly from the floss opening 91 can be employed for flossing teeth 20. A tongue cleaner 114 is applied to a top side 116 of the head 32 and the tongue cleaner 114 includes a pad 118 that is attached to the top side 116 of the head 32 and a plurality of knobs 120 each extending away from the pad 118.

The toothbrush 12 has a wipe chamber 122 accessible through opening of a wipe cover 124. The wipe chamber 122 is positioned between the floss chamber 90 and the base 34 of the toothbrush 12. The wipe cover 124 is pivotally coupled to the outside wall 36 for covering the wipe chamber 122. A wipe 126 is removably positioned in the wipe chamber 122. The wipe 126 is moistened with a disinfectant. A wipe spool 128 is positioned within the wipe chamber 122. The wipe 126 is positioned on the wipe spool 128 and may be one of a plurality of wipes 126 in a roll on the wipe spool 128.

In use, the first disk 60 is rotated until a desired amount of the fluid toothpaste 16 is dispensed onto the bristles 18 to facilitate the toothbrush 12 to be employed for brushing teeth 20. The annular ring 86 is rotated to align the second opening 88 with the first opening 58 thereby facilitating the liquid mouthwash 26 to be dispensed through the second opening 88. Furthermore, a desired length of the dental floss 110 can be drawn outwardly from the floss opening 91 and cut with the floss cutter 112 for flossing teeth 20. In this way all aspects of dental and oral hygiene can be performed with the toothbrush 12 thereby saving storage space in a bathroom, for example, as well as reducing the number of objects that must be carried during travel, for example, for performing oral and dental hygiene.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toothpaste, mouthwash, and disinfecting wipe dispensing toothbrush device comprising:

a toothbrush having a toothpaste reservoir containing a fluid toothpaste, said toothpaste reservoir being in communication with a plurality of bristles of said toothbrush wherein said toothpaste reservoir is configured to release said fluid toothpaste onto a user's teeth for brushing the user's teeth, said toothbrush having a mouthwash reservoir containing a liquid mouthwash;

said toothbrush having a toothpaste dispenser being in communication with said toothpaste reservoir, said toothpaste dispenser being actuatable into a dispensing condition for urging said fluid toothpaste onto said plurality of bristles;

said toothbrush having a mouthwash dispenser being in communication with said mouthwash reservoir, said mouthwash dispenser being positionable in an open condition wherein said mouthwash dispenser is configured to release said fluid mouthwash into the user's mouth, said mouthwash dispenser being positionable in a closed condition to inhibit said fluid mouthwash from flowing out of said mouthwash reservoir;

said toothbrush having a wipe chamber accessible through opening of a wipe cover; and a wipe removably positioned in said wipe chamber, said wipe being moistened with a disinfectant.

2. The device according to claim 1, wherein:

said toothbrush has a head, a base and an outside wall extending between said head and said base;

said outside wall has a bottom portion and a middle portion and a top portion;

said middle portion slopes inwardly between said bottom portion and said top portion;

said outside wall associated with each of said bottom portion and said middle portion is continuously arcuate about an axis extending between said base and said head such that each of said bottom portion and said middle portion has a cylindrical shape;

said top portion has a plurality of intersecting sides being perpendicularly oriented with each other such that said top portion has a rectangular shape;

each of a first lateral side and a second lateral side associated with said plurality of intersecting sides curves outwardly at a center point of said top portion to define said head of said toothbrush;

each of said plurality of bristles is positioned on a bottom side of said head;

said toothpaste reservoir is positioned in said bottom portion of said outside wall and extends into said top portion of said outside wall; and said head has a pair of toothpaste openings each extending through said bottom side of said head into said toothpaste reservoir thereby facilitating said fluid toothpaste to flow outwardly through said pair of toothpaste openings.

3. The device according to claim 2, wherein:

said bottom portion of said outside wall has a recess extending into an outside surface of said bottom portion of said outside wall, said recess extending around a full circumference of said bottom portion, said recess being spaced from said base; and said bottom portion of said outside wall has a first opening extending into said mouthwash reservoir thereby facilitating said first opening to release said liquid mouthwash from said mouthwash reservoir, said first opening being positioned in said recess.

4. The device according to claim 3, wherein:

said mouthwash dispenser comprises an annular ring being rotatably positioned in said recess in said bottom portion of said outside wall of said toothbrush;

said annular ring has a second opening extending through said annular ring;

said annular ring is rotatable into a dispensing position having said second opening being aligned with said first opening in said bottom portion of said outside wall thereby facilitating said second opening to release said liquid mouthwash from said mouthwash reservoir; and said annular ring is rotatable into a closed position having said second opening being offset from said first opening thereby inhibiting said liquid mouthwash from flowing from said mouthwash reservoir.

5. The device according to claim 2, wherein:

said toothpaste dispenser comprises a first disk being rotatably integrated into said bottom portion of said outside wall;

said first disk has a first ledge located adjacent to an upper end of said first disk which slidably engages a first recess in an interior surface of said bottom portion of said outside wall;

said first disk has a second ledge located adjacent to a lower end of said first disk which slidably engages a second recess in said interior surface of said bottom portion of said outside wall thereby facilitating said first disk to be rotated about said axis extending between said base and said head of said toothbrush; and said upper end of said first disk defines a lower threshold of said toothpaste reservoir.

6. The device according to claim 5, wherein said toothpaste dispenser includes:

a rail being integrated into said interior surface of said bottom portion of said outside wall, said rail being oriented to extend along a line being parallel to said axis extending between said base and said head of said toothbrush;

a screw being attached to and extending upwardly from said upper end of said first disk such that said screw extends into said toothpaste reservoir; and a second disk being positioned within said toothpaste reservoir, said screw extending through a top surface and a bottom surface of said second disk, a perimeter edge of said second disk engaging said rail thereby inhibiting said second disk from rotating, said second disk travelling upwardly along said screw when said first disk is rotated in a first direction such that said second disk urges said fluid toothpaste to travel outwardly through said pair of toothpaste openings for releasing said fluid toothpaste onto said plurality of bristles, said second disk travelling downwardly along said screw when said first disk is rotated in a second direction.

7. The device according to claim 2, wherein:

said toothbrush has a floss chamber being integrated into an interior of said toothbrush, said floss chamber being positioned between said base of said toothbrush and said mouthwash reservoir;

said bottom portion of said outside wall of said toothbrush has a floss opening extending into said floss chamber; and said device includes a spool of dental floss being rotatably positioned in said floss chamber.

8. The device according to claim 7, wherein:

said spool of dental floss has a first knob extending away from a top side of said spool of dental floss;

said spool of dental floss has a second knob extending away from a bottom side of said spool of dental floss;

said first knob extends into an engagement recess in an upper wall of said floss chamber;

said second knob extends into an engagement recess in a lower wall of said floss chamber for rotatably retaining said spool of dental floss in said floss chamber; and said dental floss extends outwardly through said floss opening in said bottom portion of said outside wall of said toothbrush thereby facilitating said dental floss to be pulled from said spool of dental floss.

9. The device according to claim 8, further comprising a floss cutter being attached to said bottom portion of said outside wall of said toothbrush, said floss cutter being positioned adjacent to said floss opening in said bottom portion of said outside wall thereby facilitating said dental floss that is pulled outwardly from said floss opening to be cut wherein said dental floss that is pulled outwardly from said floss opening to be employed for flossing teeth.

10. The device according to claim 2, further comprising said wipe chamber being positioned in said bottom portion of said outside wall.

11. The device according to claim 7, further comprising said wipe chamber being positioned between said floss chamber and said base of said toothbrush.

12. The device of claim 1, further comprising said wipe cover being pivotally coupled to said outside wall for covering said wipe chamber.

13. The device of claim 1, further comprising a wipe spool positioned within said wipe chamber, said wipe being positioned on said wipe spool.

14. A toothpaste, mouthwash, and disinfecting wipe dispensing toothbrush device for dispensing toothpaste and mouthwash for dental care, said device comprising:

a toothbrush having a toothpaste reservoir containing a fluid toothpaste, said toothpaste reservoir being in communication with a plurality of bristles of said toothbrush wherein said toothpaste reservoir is configured to release said fluid toothpaste onto a user's teeth for brushing the user's teeth, said toothbrush having a toothpaste dispenser being in communication with said toothpaste reservoir, said toothpaste dispenser being actuatable into a dispensing condition for urging said fluid toothpaste onto said plurality of bristles, said toothbrush having a mouthwash reservoir containing a liquid mouthwash, said toothbrush having a mouthwash dispenser being in communication with said mouthwash reservoir, said mouthwash dispenser being positionable in an open condition wherein said mouthwash dispenser is configured to release said fluid mouthwash into the user's mouth, said mouthwash dispenser being positionable in a closed condition to inhibit said fluid mouthwash from flowing out of said mouthwash reservoir, said toothbrush having a head, a base and an outside wall extending between said head and said base, said outside wall having a bottom portion and a middle portion and a top portion, said middle portion sloping inwardly between said bottom portion and said top portion, said outside wall associated with each of said bottom portion and said middle portion being continuously arcuate about an axis extending between said base and said head such that each of said bottom portion and said middle portion has a cylindrical shape, said top portion having a plurality of intersecting sides being perpendicularly oriented with each other such that said top portion has a rectangular shape, each of a first lateral side and a second lateral side associated with said plurality of intersecting sides curving outwardly at a center point of said top portion to define said head of said toothbrush, each of said plurality of bristles being positioned on a bottom side of said head, said toothpaste reservoir being positioned in said bottom portion of said outside wall and extending into said top portion of said outside wall, said head having a pair of toothpaste openings each extending through said bottom side of said head into said toothpaste reservoir thereby facilitating said fluid toothpaste to flow outwardly through said pair of toothpaste openings, said bottom portion of said outside wall having a recess extending into an outside surface of said bottom portion of said outside wall, said recess extending around a full circumference of said bottom portion, said recess being spaced from said base, said bottom portion of said outside wall having a first opening extending into said mouthwash reservoir thereby facilitating said first opening to release said liquid mouthwash from said mouthwash reservoir, said first opening being positioned in said recess, said toothpaste dispenser comprising:

a first disk being rotatably integrated into said bottom portion of said outside wall, said first disk having a first ledge located adjacent to an upper end of said first disk which slidably engages a first recess in an interior surface of said bottom portion of said outside wall, said first disk having a second ledge located adjacent to a lower end of said first disk which slidably engages a second recess in said interior surface of said bottom portion of said outside wall thereby facilitating said first disk to be rotated about said axis extending between said base and said head of said toothbrush, said upper end of said first disk defining a lower threshold of said toothpaste reservoir;

a rail being integrated into said interior surface of said bottom portion of said outside wall, said rail being oriented to extend along a line being parallel to said axis extending between said base and said head of said toothbrush;

a screw being attached to and extending upwardly from said upper end of said first disk such that said screw extends into said toothpaste reservoir; and a second disk being positioned within said toothpaste reservoir, said screw extending through a top surface and a bottom surface of said second disk, a perimeter edge of said second disk engaging said rail thereby inhibiting said second disk from rotating, said second disk travelling upwardly along said screw when said first disk is rotated in a first direction such that said second disk urges said fluid toothpaste to travel outwardly through said pair of toothpaste openings for releasing said fluid toothpaste onto said plurality of bristles, said second disk travelling downwardly along said screw when said first disk is rotated in a second direction;

said mouthwash dispenser comprising an annular ring being rotatably positioned in said recess in said bottom portion of said outside wall of said toothbrush, said annular ring having a second opening extending through said annular ring, said annular ring being rotatable into a dispensing position having said second opening being aligned with said first opening in said bottom portion of said outside wall thereby facilitating said second opening to release said liquid mouthwash from said mouthwash reservoir, said annular ring being rotatable into a closed position having said second opening being offset from said first opening thereby inhibiting said liquid mouthwash from flowing from said mouthwash reservoir;

said toothbrush having a floss chamber being integrated into an interior of said toothbrush, said floss chamber being positioned between said base of said toothbrush and said mouthwash reservoir, said bottom portion of said outside wall of said toothbrush having a floss opening extending into said floss chamber;

a spool of dental floss being rotatably positioned in said floss chamber, said spool of dental floss having a first knob extending away from a top side of said spool of dental floss, said spool of dental floss having a second knob extending away from a bottom side of said spool of dental floss, said first knob extending into a engagement recess in an upper wall of said floss chamber, said second knob extending into an engagement recess in a lower wall of said floss chamber for rotatably retaining said spool of dental floss in said floss chamber, said dental floss extending outwardly through said floss opening in said bottom portion of said outside wall of said toothbrush thereby facilitating said dental floss to be pulled from said spool of dental floss;

a floss cutter being attached to said bottom portion of said outside wall of said toothbrush, said floss cutter being positioned adjacent to said floss opening in said bottom portion of said outside wall thereby facilitating said dental floss that is pulled outwardly from said floss opening to be cut wherein said dental floss that is pulled outwardly from said floss opening to be employed for flossing teeth;

a tongue cleaner being applied to a top side of said head, said tongue cleaner including a pad being attached to said top side of said head and a plurality of knobs each extending away from said pad;

said toothbrush having a wipe chamber accessible through opening of a wipe cover, said wipe chamber being positioned between said floss chamber and said base of said toothbrush, said wipe cover being pivotally coupled to said outside wall for covering said wipe chamber;

a wipe removably positioned in said wipe chamber, said wipe being moistened with a disinfectant; and a wipe spool positioned within said wipe chamber, said wipe being positioned on said wipe spool.

* * * * *